US006589093B1

(12) United States Patent
Morgan

(10) Patent No.: US 6,589,093 B1
(45) Date of Patent: Jul. 8, 2003

(54) INTEGRAL RESILIENT BADGE AND SUCKER

(76) Inventor: Grant Kennedy Morgan, 5 Victoria Avenue, Finchley, London N3 1BD (GB)

( * ) Notice: Subject to any disclaimer, the term of this patent is extended or adjusted under 35 U.S.C. 154(b) by 0 days.

(21) Appl. No.: 09/937,197

(22) PCT Filed: Mar. 7, 2000

(86) PCT No.: PCT/GB00/00820

§ 371 (c)(1),
(2), (4) Date: Jan. 15, 2002

(87) PCT Pub. No.: WO00/57392

PCT Pub. Date: Sep. 28, 2000

(30) Foreign Application Priority Data

Mar. 23, 1999 (GB) ..... 9906747

(51) Int. Cl.[7] ..... A63H 33/00
(52) U.S. Cl. ..... 446/177; 446/268; 40/597
(58) Field of Search ..... 446/268, 177, 446/176; 273/DIG. 25; 248/205.5, 205.6

(56) References Cited

U.S. PATENT DOCUMENTS

| | | | | | |
|---|---|---|---|---|---|
| 1,518,943 | A | * | 12/1924 | Story | 248/205.5 |
| 1,710,989 | A | * | 4/1929 | Kelly | 446/177 |
| 1,800,218 | A | | 4/1931 | Janda | |
| 1,932,154 | A | | 10/1933 | Briggs | |
| 2,219,130 | A | * | 10/1940 | Herrmann | 273/DIG. 25 |
| 2,484,343 | A | * | 10/1949 | Hawes | 446/177 |
| 2,728,168 | A | * | 12/1955 | Gier | 446/177 |
| 3,638,354 | A | * | 2/1972 | Morrison | 446/177 |
| 3,703,784 | A | * | 11/1972 | Wigal | 446/177 |
| 4,235,041 | A | * | 11/1980 | Sweet | 248/206.4 |
| 4,258,500 | A | * | 3/1981 | Anderson | 466/177 |
| 4,291,490 | A | * | 9/1981 | Ikeda | 446/90 |
| D281,890 | S | * | 12/1985 | Routzong et al. | D21/622 |
| 5,118,318 | A | * | 6/1992 | Lorizio | 446/72 |
| 5,288,257 | A | * | 2/1994 | Zacherl | 446/177 |
| 5,498,193 | A | * | 3/1996 | Locricchio | 446/361 |
| 5,692,943 | A | * | 12/1997 | Copp | 273/DIG. 25 |
| 5,722,871 | A | * | 3/1998 | Zamir | 446/153 |
| 5,742,971 | A | | 4/1998 | Salinger | |
| 5,964,437 | A | * | 10/1999 | Belokin et al. | 248/205.5 |
| 6,264,524 | B1 | * | 7/2001 | Crane et al. | 446/177 |

FOREIGN PATENT DOCUMENTS

| | | | | | |
|---|---|---|---|---|---|
| DE | 3767862 | G | * | 3/1991 | A63H/18/02 |
| FR | 2 569 891 | | | 3/1986 | |
| GB | 1513023 | A | * | 6/1978 | A63H/3/36 |
| GB | 2084474 | A | * | 4/1982 | A63H/11/04 |
| GB | 2267444 | A | * | 12/1993 | A63H/33/18 |
| JP | 2002019396 | A | * | 1/2002 | A63H/33/00 |

* cited by examiner

*Primary Examiner*—Derris H. Banks
*Assistant Examiner*—Urszula M Cegielnik
(74) *Attorney, Agent, or Firm*—Woodcock Washburn LLP

(57) ABSTRACT

The invention provides a resilient, moulded figure, intended for fun and/or decoration, which can be temporarily stuck, by means of a sucker, to flat surfaces such as window panes, refrigerator doors, bathroom tiles, children's blackboards, etc., and aims to address particularly, with children's safety in mind, the security with which the sucker is attached to the figure. Utilising moulding techniques requiring the sequential application of resilient plastics material to a mould, front and rear-facing surfaces of the figure are formed, and the rear-facing surface is attached adhesively to a tubular sleeve of resilient material which has a portion dimensioned to closely surround a relatively narrow neck portion disposed between the active area of a sucker and a bulbous end portion of the sucker, which end portion is accommodated by another portion of the sleeve.

11 Claims, 1 Drawing Sheet

INTEGRAL RESILIENT BADGE AND SUCKER

This invention relates to decorative figures, by which is meant moulded figures, such as representations of comic characters, intended for fun and/or decoration, and in particular to such figures intended to be capable of at least temporary adherence to flat surfaces such as window panes, refrigerator doors, bathroom tiles, children's blackboards, etc. The invention also encompasses a method of making such figures.

Figures for the kind referred to above are typically (though not necessarily) intended for use by children and may, for example, be regarded as small and inexpensive toys. Typically, therefore, they may be distributed in ways associated with such toys, such as by inclusion in packets of cereal, Christmas or celebration crackers and the like, and thus safety is a principal consideration in the construction of such figures.

It is known for such figures to be moulded of plastics material which sets to rigid form, and to be decorated to present a brightly-coloured front surface that depicts the character or design in question. The rear surface typically bears an outstanding pillar, integrally formed with the figure as a whole, that is designed to receive, as an interference fit thereover, the hollow shaft of a resilient suction device intended to constitute the means of securing the figure, temporarily at least, to a desired flat surface. The extent of such figures in each of their two major dimensions is typically (though of course not necessarily) between two and five centimeters, and they can thus exhibit significant drawbacks from the safety standpoint, in that their size coupled with their rigidity leads to the possibility of unsupervised children putting such figures in their mouths and swallowing or semi-swallowing them, with the potential of causing choking and/or physical damage to the mouth, throat or oesophageal tract. Moreover, the separability of the suction device from the figure itself increases the risk of swallowing, and also gives rise to the possibility of the suction device being swallowed as a separate entity.

Moulding techniques are now known by means of which it is possible to mould such figures in resilient material and, by the sequential application to a mould of material forming respectively front and rear-facing surfaces of the figures, to create figures having the advantage not only of exhibiting resilience as a structure, but also considerable improvement in relation to their three-dimensional topography, detail and colour. Resilient figures moulded by such techniques, therefore, are more attractive than the rigid figures referred to above, and are generally safer because of their resilience. However, the figures produced to date by means of this process have incorporated metallic devices, such as the spike components of butterfly-type tie pins, for mounting or attachment of the figures to desired media, such as clothing, and such fixtures would be entirely inappropriate for the purposes envisaged herein.

It is an object of this invention to address at least one of the problems and difficulties outlined above and exhibited by existing mouldings and/or by the techniques used for making them.

According to the invention from one aspect, there is provided a moulded, resilient decorative figure (as herein defined), the figure having a first major surface, intended to be viewed, moulded to a desired shape and configuration by the application of resilient material to a mould shaped to define respective features of the figure, and a second major surface facing away from the first surface and comprising a backing layer of similarly resilient material; the figure including a suction device having a bulbous base portion connected to a sucker member by way of a relatively narrow neck portion and a tubular sleeve member of resilient material dimensioned to closely surround the neck portion of said suction device and having a cavity accommodating the bulbous portion of said suction device; the suction device and the sleeve being adhesively secured to the second major surface of said figure, such that the sucker device faces away from the figure.

By this means, the advantages of high resolution moulding techniques are combined with safe and secure fixing of the suction device to the figure as a whole.

Preferably the bulbous portion of the suction device, when fitted into its sleeve member, lies somewhat above the plane defined by the circular end of the sleeve member which defines the open end of said cavity so as to permit excess adhesive to well up within the sleeve, thereby to contact the bulbous portion itself and to create a direct and powerful adhesive bond between the suction device and the figure, in addition to the indirect bonding of the suction device to the figure that occurs by virtue of the adhesive bonding of the sleeve to the figure and the firm entrapment of the bulbous portion of the suction device within the sleeve cavity. In any event, the suction device as a whole is formed separately, and of itself as an integral component, for adhesive fixing, with its sleeve, to the decorative figure. The colouration of the suction device and/or its sleeve, is preferably such as to blend with, or provide a desired amount of contrast to, part at least of the figure itself and, in particular, to the backing member.

According to the invention from another aspect there is provided a method of making a resilient decorative figure comprising the steps of applying material to a mould defining a desired outline shape for the figure and also the shape and configuration of respective features intended to be displayed by a first major surface of the figure; forming a backing component, by the application of further material to the mould, to create a second major surface of the figure; providing a suction member intended for the mounting of the figure to a flat surface, said suction member comprising a sucker component and a bulbous component integrally formed therewith; providing a sleeve dimensioned to encircle and entrap the bulbous component, and adhesively securing at least the sleeve to the second major surface of said figure.

Preferably the said sucker component and bulbous component are separated by a relatively narrow neck; the sleeve closely surrounding the neck and having a part dimensioned to accommodate the bulbous component. By this means, the sucker member effectively becomes powerfully secured to the figure. Moreover, if, as is advantageous, the bulbous component is so dimensioned as to not quite reach the plane formed by that end of the sleeve surrounding the bulbous component and intended to be adhesively secured to the figure, excess adhesive applied between the sleeve and the figure can well up inside the sleeve to contact the base of the bulbous component, thereby ensuring that the suction member itself is directly adherent to the figure, as well as being indirectly adherent thereto by virtue of the entrapment of said bulbous portion within the sleeve, which sleeve is firmly adherent to the figure, thus creating, to all intents and purposes, an integral unit.

In order that the invention may be clearly understood and readily carried into effect, one embodiment thereof will now be described, by way of example only, with reference to the accompanying drawings, of which:

Figure 1:
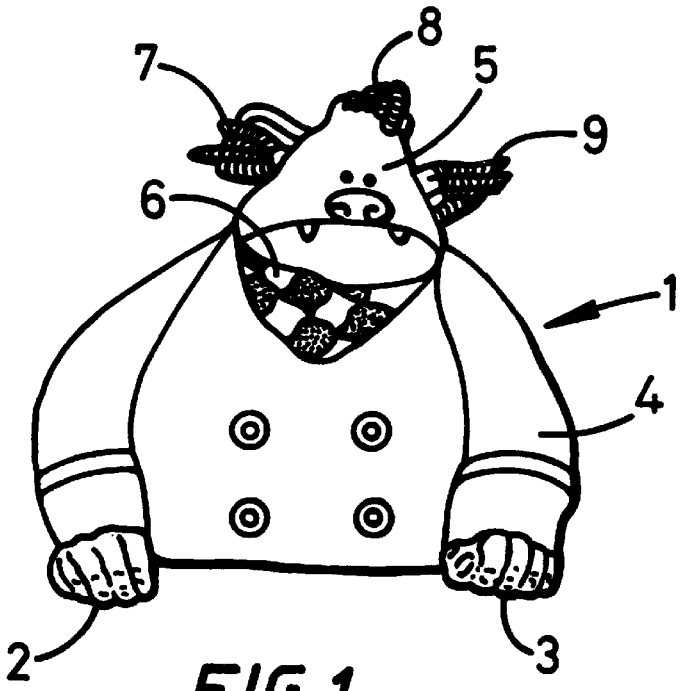
FIG. 1 shows a front elevation of a decorative figure in accordance with one example of the invention.

Referring now to FIG. 1, there is shown in front elevation, and not to scale, a decorative figure in the form of a character 1. The character may, of course, take any desired form but in this example it constitutes a waist-upwards representation of a fictional person.

The character 1 is constructed so as to be resilient and flexible, and to exhibit high resolution definition between its various features. This is achieved by means of a sequential moulding process, of a kind known per se, in which a suitable resilient material, such as soft PVC, is applied to a mould (not shown) which is configured to impose upon the material both a desired outline for the character 1 and a desired surface topography to create the desired physical appearance of the character. It will be appreciated that the surface of the material which is so moulded or impressed in that which, when the figure is finished, is intended to be viewed, and constitutes a first major surface of the figure. In general, the said surface is not flat, but rather is formed with three-dimensional topography representing various features of the character 1. Examples of such features, which are all created in the moulding operation, are the hands 2, 3; the jacket 4; the face 5; the cravat 6 and the tufts of hair 7, 8 and 9. Colouration may be achieved by means of any convenient process, combination of processes and/or by manual application.

Figure 3:
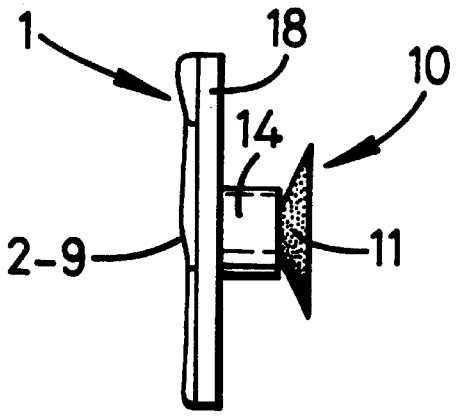
FIG. 3 shows, in side elevation, the suction device secured, by one example of the invention, to the decorative figure.

A second major surface of the figure, which may well be flat, is not intended to be of visual interest, but merely provides a backing member (not visible in FIG. 1, but shown schematically at 18 in FIG. 3). It conforms to the desired outline of the character 1, and is created by the application of suitable material (such as the same soft PVC as used in the moulding of the features 2–9) to the mould, effectively on top of the previously applied material that has formed, or is in the process of forming (depending upon whether or not it is "set" at the time) the first major surface of the character 1. The reverse surface of the backing member 18 (FIG. 3) thus faces away from the moulded surface bearing the features 2–9 and constitutes the second major surface of the figure.

Figure 2:
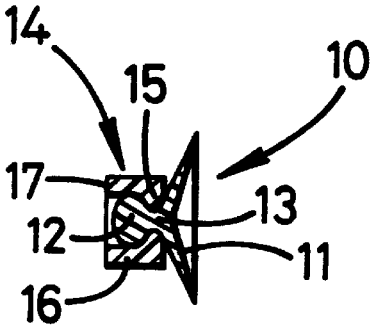
FIG. 2 shows, in side elevation, a suction member suitable for use with the decorative figure of the invention and, in cross-section, a sleeve for use therewith.

FIG. 2 shows a suction device 10 intended for use with the character 1 and intended to allow the character to be affixed, at least temporarily, to a smooth, flat surface such as a window pane, a headboard, bathroom tiles or the like. The suction device is formed in any convenient manner and in this example comprises a sucker portion 11 of conventional, hollow, frusto-conical form, integrally formed with a bulbous portion 12 which is separated from the sucker portion 11 by a neck portion 13 of relatively small diameter. The suction device 10 can take any convenient form that is convenient for fabrication and capable of being anchored, by the technique now to be described, to the character 1, particularly bearing in mind that considerable force, tending to separate the suction device 10 from the character 1, might well be applied in use when someone wishes to remove the figure from a surface to which it has become firmly attached.

In accordance with this example of the invention, there is provided a sleeve 14 of resilient material, such as plastics or rubbery material, a first portion 15 of which is configured to closely surround the neck portion 13 of the suction device 10 and a second portion 16 of which comprises a cavity dimensioned to accommodate the bulbous portion 12 of the suction device 10. The end 17 of the sleeve remote from its first portion 15 presents a planar, annular surface which is intended to be secured by means of adhesive of any convenient kind capable of forming a powerful bond between the sleeve 14 and the reverse surface of the backing member 18 of the character 1. Preferably, the base of the bulbous portion 12 of the suction device 10 does not quite reach the plane of the annular surface presented by end 17 of the sleeve 14, thus forming a region into which excess adhesive can well when the sleeve 14 is pressed into contact with the reverse surface of the backing member 18 with adhesive therebetween. The adhesive thus wells into contact with the base of the bulbous portion 12 of the suction device 10 and permits the formation of a direct adhesive bond between the suction device 10 and the reverse surface of the backing member 18, thus further strengthening the bond.

The sucker portion 11 can take forms other than the regular frusto-conical form shown in the drawings if desired.

In accordance with this example of the invention, therefore, the bulbous member 12 of the suction device 10 is entrapped within the sleeve 14 which itself is directly adhesively secured to the character 1. Preferably, the bulbous member 12 is also directly adherent to the character 1 as described above. Preferably also, the colouration of the suction device 10, and/or of the sleeve 14, is chosen to blend or contrast with either that of the base of the FIG. 1 itself or that of one or more of the features which overlie it in the finished article.

The entire decorative FIG. 1, including the suction device 10, is thus flexible and all parts thereof are firmly secured together without the need for separable parts or metallic parts that could cause problems as outlined hereinbefore if encountered by unsupervised children. It is also the case that the sequential moulding process permits the application to the decorative figure of significant and highly detailed three-dimensional topography. Moreover, aside from safety considerations, the figures moulded as described herein exhibit extremely satisfying tactile characteristics.

What is claimed is:

1. A moulded, resilient decorative figure, the figure having a first major surface, intended to be viewed, moulded to a desired shape and configuration by the application of resilient material to a mould shaped to define respective features of the figure, and a second major surface facing away from the first surface and comprising a backing layer of similarly resilient material, the figure including a suction device having a bulbous base portion connected to a sucker member by way of a relatively narrow neck portion and a tubular sleeve member of resilient material dimensioned to closely surround the neck portion of said suction device and having a cavity accommodating the bulbous portion of said suction device; wherein the bulbous portion of the suction device, when fitted into its sleeve member, lies somewhat above the plane defined by a circular end of the sleeve member which defines the open end of said cavity, the suction device and the sleeve being adhesively secured to the second major surface of said figure, such that the sucker device faces away from the figure, the open end of said cavity permitting excess adhesive to well up within the sleeve, thereby to contact the bulbous portion itself and to create a direct adhesive bond between the suction device and the figure, in addition to the indirect bonding of the suction device to the figure that occurs by virtue of the adhesive bonding of the sleeve to the figure and the firm entrapment of the bulbous portion of the suction device within the sleeve cavity.

2. A figure according to claim 1 wherein the suction device comprises a sucker member which conforms to a truncated conical shape.

3. A figure according to claim 2 wherein the said neck portion of the suction device is located directly at the narrowest section of the conical portion of the sucker member.

4. A figure according to claim 1 wherein the suction device as a whole is formed as an integral component, for adhesive fixing, with its sleeve, to the decorative figure.

5. A figure according to claim 1 wherein the colouration of the suction device is such as to blend with, or provide a desired amount of contrast to, part at least of the figure itself and, in particular, to the backing layer.

6. A method of making a resilient decorative figure comprising the steps of applying material to a mould defining a desired outline shape for the figure and also the shape and configuration of respective features intended to be displayed by a first major surface of the figure; forming a backing component, by the application of further material to the mould, to create a second major surface of the figure; providing a suction member intended for the mounting of the figure to a flat surface, said suction member comprising a sucker component and a bulbous component integrally formed therewith; providing a sleeve dimensioned to encircle and entrap the bulbous component, and adhesively securing at least the sleeve to the second major surface of said figure.

7. A method according to claim 6 wherein the said sucker component and bulbous component are separated by a relatively narrow neck; the sleeve closely surrounding the neck and having a part dimensioned to accommodate the bulbous component.

8. A method according to claim 6 wherein the bulbous component is so dimensioned as to not quite reach the plane formed by that end of the sleeve surrounding the bulbous component and intended to be adhesively secured to the figure, whereby excess adhesive applied between the sleeve and the figure can well up inside the sleeve to contact the base of the bulbous component, thereby ensuring that the suction member itself is directly adherent to the figure, as well as being indirectly adherent thereto by virtue of the entrapment of said bulbous portion within the sleeve, which sleeve is firmly adherent to the figure.

9. A figure according to claim 1 wherein the colouration of the suction device tubular sleeve member is such as to blend with, or provide a desired amount of contrast to, part at least of the figure itself and, in particular, to the backing layer.

10. A moulded, resilient decorative figure, the figure having a first major surface, intended to be viewed, moulded to a desired shape and configuration by the application of resilient material to a mould shaped to define respective features of the figure, and a second major surface facing away from the first surface and comprising a backing layer of similarly resilient material, the figure including a suction device having a bulbous base portion connected to a sucker member by way of a relatively narrow neck portion and a tubular sleeve member of resilient material dimensioned to closely surround the neck portion of said suction device and having a cavity accommodating the bulbous portion of said suction device; wherein the suction device and the sleeve are adhesively secured to the second major surface of said figure, such that the sucker device faces away from the figure, the wherein the suction device as a whole is formed as an integral component, for adhesive fixing via the tubular sleeve member to the decorative figure.

11. A moulded, resilient decorative figure, the figure having a first major surface, intended to be viewed, moulded to a desired shape and configuration by the application of resilient material to a mould shaped to define respective features of the figure, and a second major surface facing away from the first surface and comprising a backing layer of similarly resilient material, the figure including a suction device having a bulbous base portion connected to a sucker member by way of a relatively narrow neck portion and a tubular sleeve member of resilient material dimensioned to closely surround the neck portion of said suction device and having a cavity accommodating the bulbous portion of said suction device; wherein the suction device and the sleeve are adhesively secured to the second major surface of said figure, such that the sucker device faces away from the figure, and wherein the colouration of the suction device tubular sleeve member is such as to blend with, or provide a desired amount of contrast to, part at least of the figure itself and, in particular, to the backing layer.

* * * * *